US007597182B2

(12) United States Patent
Illedits et al.

(10) Patent No.: US 7,597,182 B2
(45) Date of Patent: Oct. 6, 2009

(54) ESCALATOR OR MOVING WALK WITH DRIVE

(75) Inventors: Thomas Illedits, Neufeld (AT); Michael Matheisl, Vosendorf (AT); Alexander Prenner, Pottsching (AT); Michael Berger, Konigstetten (AT)

(73) Assignee: Inventio AG, Hergiswil (CH)

( * ) Notice: Subject to any disclaimer, the term of this patent is extended or adjusted under 35 U.S.C. 154(b) by 28 days.

(21) Appl. No.: 11/857,565

(22) Filed: Sep. 19, 2007

(65) Prior Publication Data

US 2008/0067034 A1 Mar. 20, 2008

(30) Foreign Application Priority Data

Sep. 19, 2006 (EP) ..... 06120873

(51) Int. Cl.
*B66B 21/00* (2006.01)

(52) U.S. Cl. ..... 198/330

(58) Field of Classification Search ..... 198/330
See application file for complete search history.

(56) References Cited

U.S. PATENT DOCUMENTS

| | | | | |
|---|---|---|---|---|
| 3,677,388 | A * | 7/1972 | Boltrek et al. | 198/833 |
| 3,857,301 | A | 12/1974 | Hanks et al. | |
| 4,775,044 | A * | 10/1988 | Hofling | 198/330 |
| 4,809,841 | A * | 3/1989 | Kitamura | 198/330 |
| 5,224,580 | A * | 7/1993 | Nurnberg et al. | 198/330 |
| 6,247,575 | B1 * | 6/2001 | Thiel | 198/330 |
| 6,260,687 | B1 * | 7/2001 | Ulrich | 198/330 |
| 6,273,235 | B1 * | 8/2001 | Inoue | 198/330 |
| 2006/0006046 | A1 * | 1/2006 | Berger et al. | 198/326 |

FOREIGN PATENT DOCUMENTS

| | | |
|---|---|---|
| DE | 199 52 168 A1 | 5/2001 |
| DE | 101 36 031 B4 | 2/2003 |
| JP | 2002 053282 A | 2/2002 |
| WO | WO 97/31854 | 9/1997 |

* cited by examiner

*Primary Examiner*—Mark A Deuble
(74) *Attorney, Agent, or Firm*—Ladas & Parry LLP

(57) ABSTRACT

An escalator or moving walk has a drive arranged in a reversing area. The drive drives chain wheels that move the step band or pallet band and include a motor, an axial gear, a first hollow shaft and a second hollow shaft. The motor drives a belt to drive a gear input shaft that runs coaxial to the first hollow shaft. Arranged at one end of the gear input shaft is an operating brake; the other end of the gear input shaft is connected to the axial gear. A first flange connects a first chain wheel to a truss. A second chain wheel is arranged at one end of the second hollow shaft; the other end of the second hollow shaft is connected to the housing of the axial gear. A second flange connected to a side plate serves as a torque converter bearing for the axial gear.

10 Claims, 7 Drawing Sheets

ESCALATOR OR MOVING WALK WITH DRIVE

The invention relates to an escalator or moving walk with a drive in the reversing area between the incoming and outgoing step band or pallet band, respectively, wherein driving wheels, that are connected via a shaft that can be driven by the drive, drive the step band or pallet band respectively.

BACKGROUND OF THE INVENTION

From patent specification DE 101 36 031 B4 a drive for a passenger transportation system has become known that is arranged in the reversing area of the step band or pallet band, respectively, and drives the step band or pallet band. By positive engagement the chain wheels move chains on which are arranged steps or pallets, respectively, for the transportation of persons and light goods. Provided on each side of the step band or pallet band is a chain wheel, the chain wheels being connected by means of a hollow shaft. Arranged in the hollow shaft is a gear wherein the gear pot is executed as part of the hollow shaft. A motor arranged coaxially with the hollow shaft drives the input shaft of the gear.

It is a purpose of the present invention to provide a drive construction that is more compactly constructed and economical to manufacture and maintain.

BRIEF DESCRIPTION OF THE INVENTION

In an escalator or moving walk according to the invention, the drive is arranged in the reversing area between the incoming and outgoing step band or pallet band. Driving wheels or chain wheels that are connected via a shaft can be driven by the drive driving the step band or pallet band. At least one drive is arranged in the space formed by side plates of the reversing area and the incoming and outgoing step band or pallet band.

The advantages achieved by means of the invention are mainly to be seen in that the space that is formed by the incoming and outgoing step band or pallet band respectively and the side plates are used for the drive. With this form of construction, a normal commercially available and inexpensive motor can be used. The operating brake acts directly on the gear input shaft and can therefore have small or smaller dimensions. Both motor and brake are readily accessible for maintenance and servicing. By means of a belt, chain, band, or rope, the motor drives the rapidly rotating gear input shaft of an axial gear. The housing of the gear rotates and is connected at one end with the hollow shaft, there being arranged at one end of the hollow shaft a chain wheel. By means of a torque converter bearing, the drive shaft of the axial gear is connected to the side plate and/or truss of the reversing area of the escalator or moving walk. The axial gear and hollow shaft can be easily and simply preassembled, as well as easily mounted and held in bearings on the truss. On the truss or rail block itself, only a bearing is required on the drive side. Furthermore, the constructional conditions of the drive according to the invention can be embodied in a construction with two motors and two axial gears with the same spatial conditions.

BRIEF DESCRIPTION OF THE DRAWINGS

The present invention is described in more detail in the following detailed disclosure of a preferred, but nonetheless illustrative embodiment with reference to the attached figures, wherein.

DETAILED DESCRIPTION OF THE INVENTION

Figure 1:
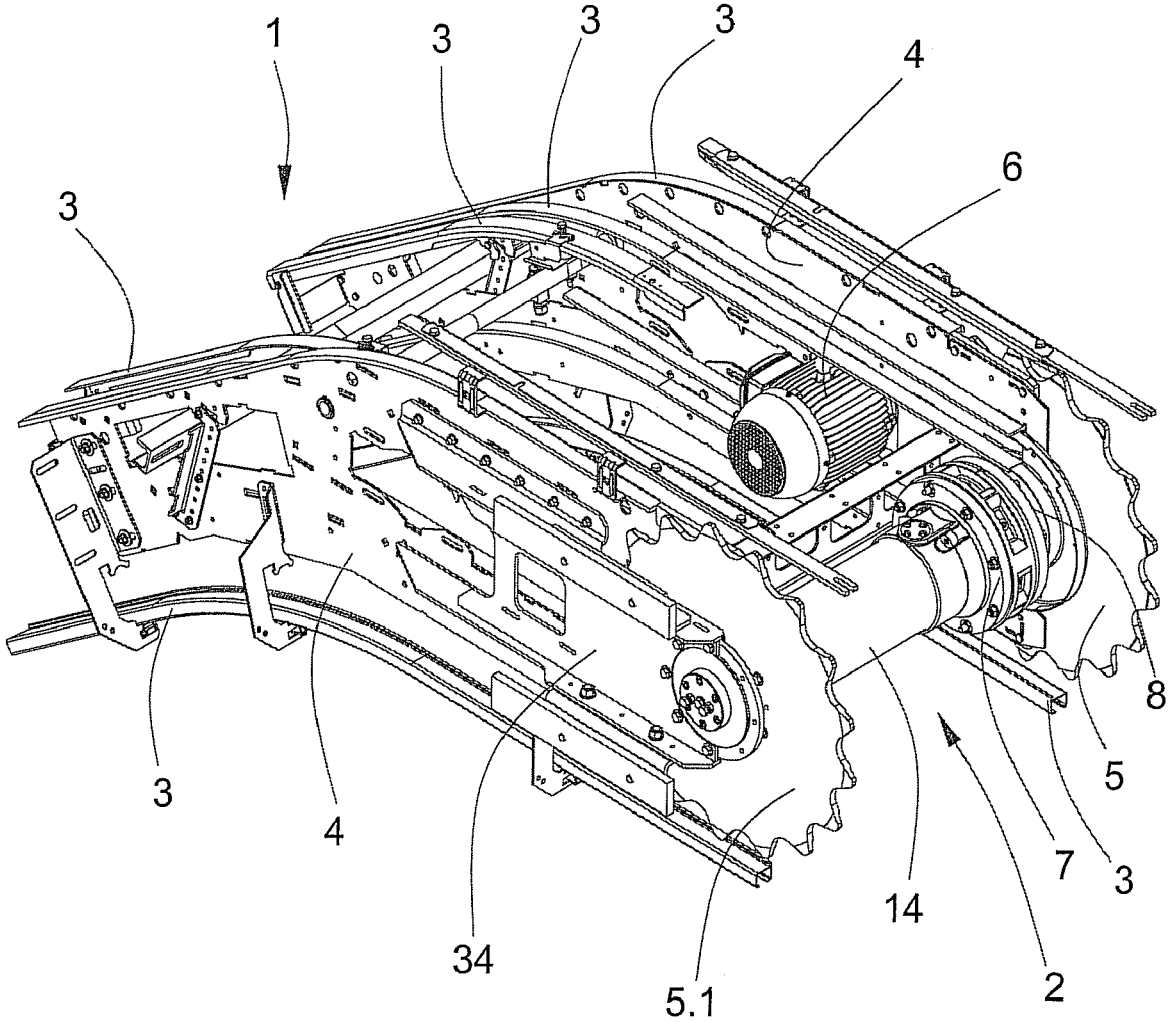
FIG. 1 is a perspective view of a reversing area of an escalator or moving walk with the drive according to the invention.

FIG. 1 shows a reversing area 1 of an escalator or moving walk with a drive 2 according to the invention. Not shown are the step band or pallet band whose step chain rollers or pallet chain rollers and step running rollers or pallet running rollers are guided by means of guiderails 3. The guiderails 3 are borne by a truss or by side plates 4. Also not shown is the balustrade base, the balustrade, and the handrail of the escalator or moving walk. On each side, the chain of the step band or pallet band enters into positive engagement with a first or left and second or right chain wheel 5, 5.1, whereby the step band or pallet band is moved or transported by means of the two chain wheels 5, 5.1.

The chain wheels 5, 5.1 are driven by means of the drive 2. The drive 2 consists essentially of a motor 6, a first axial gear 7, a first hollow shaft 8 and a second hollow shaft 14. The axial drive gear can be, for example, a planetary gear, a Cyclo gear, an ellipsoidal gear, or a harmonic drive gear. These gears are characterized by high transmission ratios. Instead of the step chains or pallet chains and chain wheels 5, 5.1, belts or belt-like bands and belt wheels can be provided.

Figure 2:
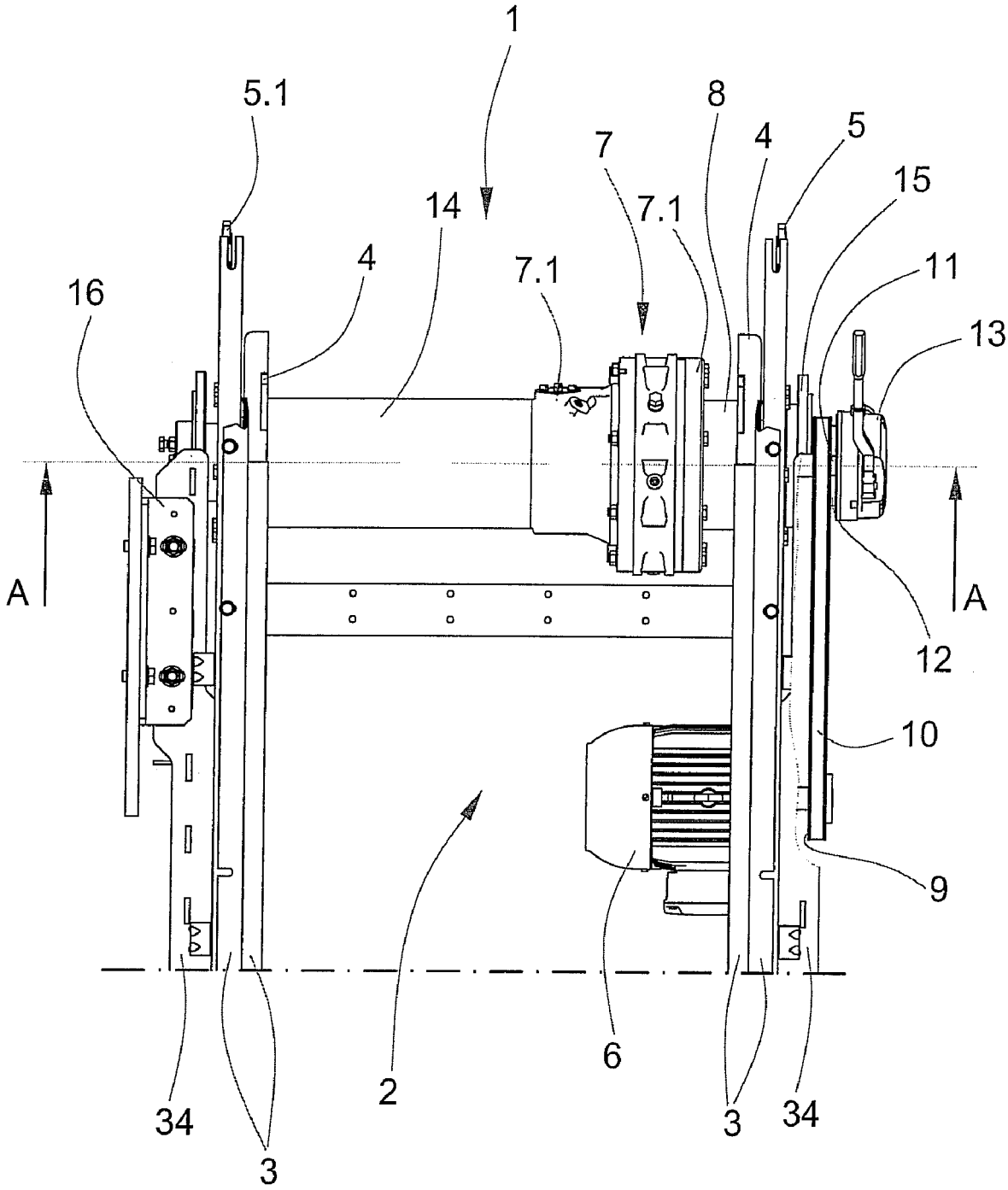
FIG. 2 is a view presenting details of the drive.

FIG. 2 shows details of the drive 2. By means of a first pulley 9 or belt, groove, band, or rope sheave, the motor 6 drives a belt 10 (or poly V belt, band, or rope) that in turn drives a second pulley 12 that is arranged on a gear input shaft 11. Arranged at one end of the rapidly rotating gear input shaft 11 is an operating brake 13; the other end of the gear input shaft 11 is connected to the first axial gear 7. The gear input shaft 11 runs coaxial to the first hollow shaft 8. A first flange 15 supports the first chain wheel 5 on the truss or side plate 4. Arranged at one end of the second hollow shaft 14 is the second chain wheel 5.1. The other end of the second hollow shaft 14 is connected to the rotating housing 7.1 of the first axial gear 7. A second flange 16 that is connected to a supporting plate 34 serves as a torque converter bearing for the first axial gear 7.

Also arranged on the hollow shafts 8, 14 can be, for example, at least one further driving wheel, for example a chain wheel, that by means of a traction means, for example, a chain, drives the handrail in synchrony with the chain wheels 5, 5.1 of the step band or pallet band.

Figure 3:
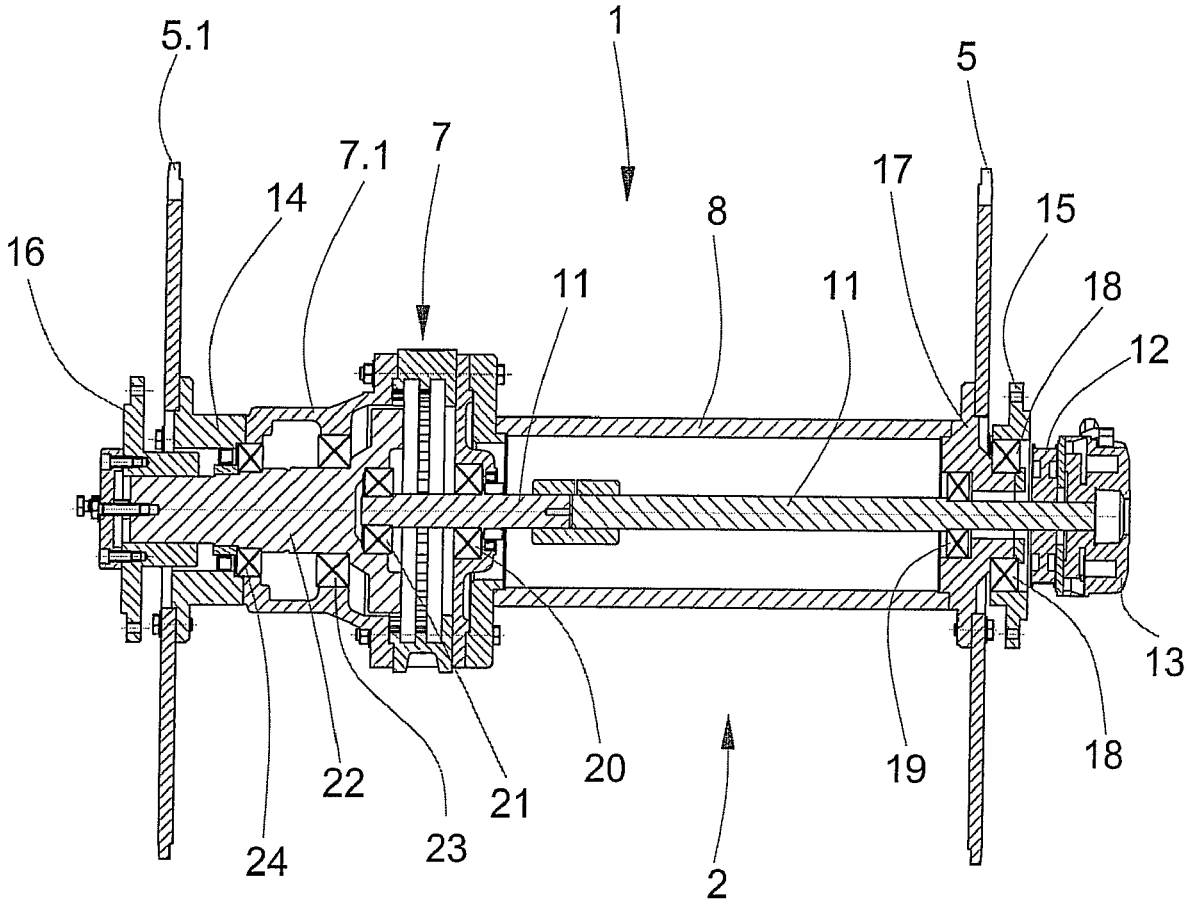
FIG. 3 is a cross-section view taken along line A-A of FIG. 2.

FIG. 3 shows a cross section along the line A-A of FIG. 2. Brake 13 and second pulley 12 are connected to the rapidly rotating gear input shaft 11. Not shown is the torque converter bearing of the brake 13. Between the first flange 15 and a first bushing 17 is a first bearing 18. First chain wheel 5 and first hollow shaft 8 are connected to the first bushing 17 and thereby rotatably relative to the first flange 15. At its other end, the first hollow shaft 8 is connected to the slowly rotating housing 7.1 of the first axial gear 7. Provided between the gear input shaft 11 and the first bushing 17 is a second bearing 19. The gear input shaft 11 is borne in the housing 7.1 on a third bearing 20 and on a fourth bearing 21, the fourth bearing 21 being arranged between the rapidly rotating gear input shaft 11 and a gear output shaft 22. Provided between the second hollow shaft 14 and the gear output shaft 22 are a fifth bearing 23 and a sixth bearing 24, the second hollow shaft 14 being rotatable relative to the gear output shaft 22 and being connected at one end to the slowly rotating housing 7.1 and at the other end to the second chain wheel 5.1. By means of a second flange 16 that serves as a torque converter bearing, the gear output shaft 22 is connected tightly to the side plate 4 or truss 4.

Figure 4:
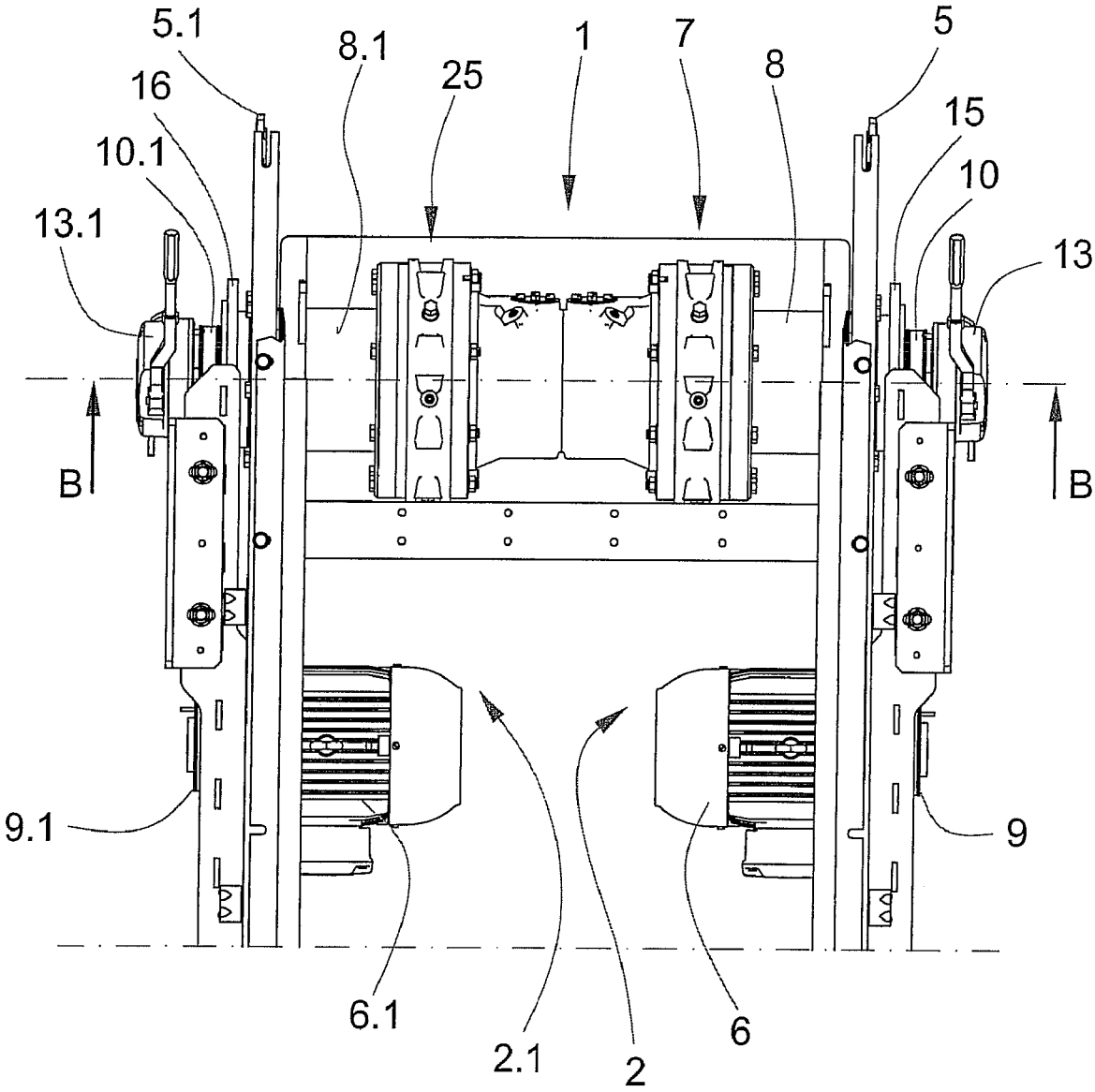
FIG. 4 is a view of a reversing area of an escalator or moving walk with two identical drives.

FIG. 4 shows a reversing area 1 of an escalator or moving walk respectively with two identical mirror-inverted drives 2, 2.1. Two drives 2, 2.1 are used particularly for large travel heights. Provided for each chain wheel 5, 5.1 is a motor 6, 6.1, traction means 10, 10.1, an axial gear 7, 25, and a brake 13, 13.1, the motors 6, 6.1 being mechanically coupled or joined by means of the axial gear 7, 25.

Figure 5:
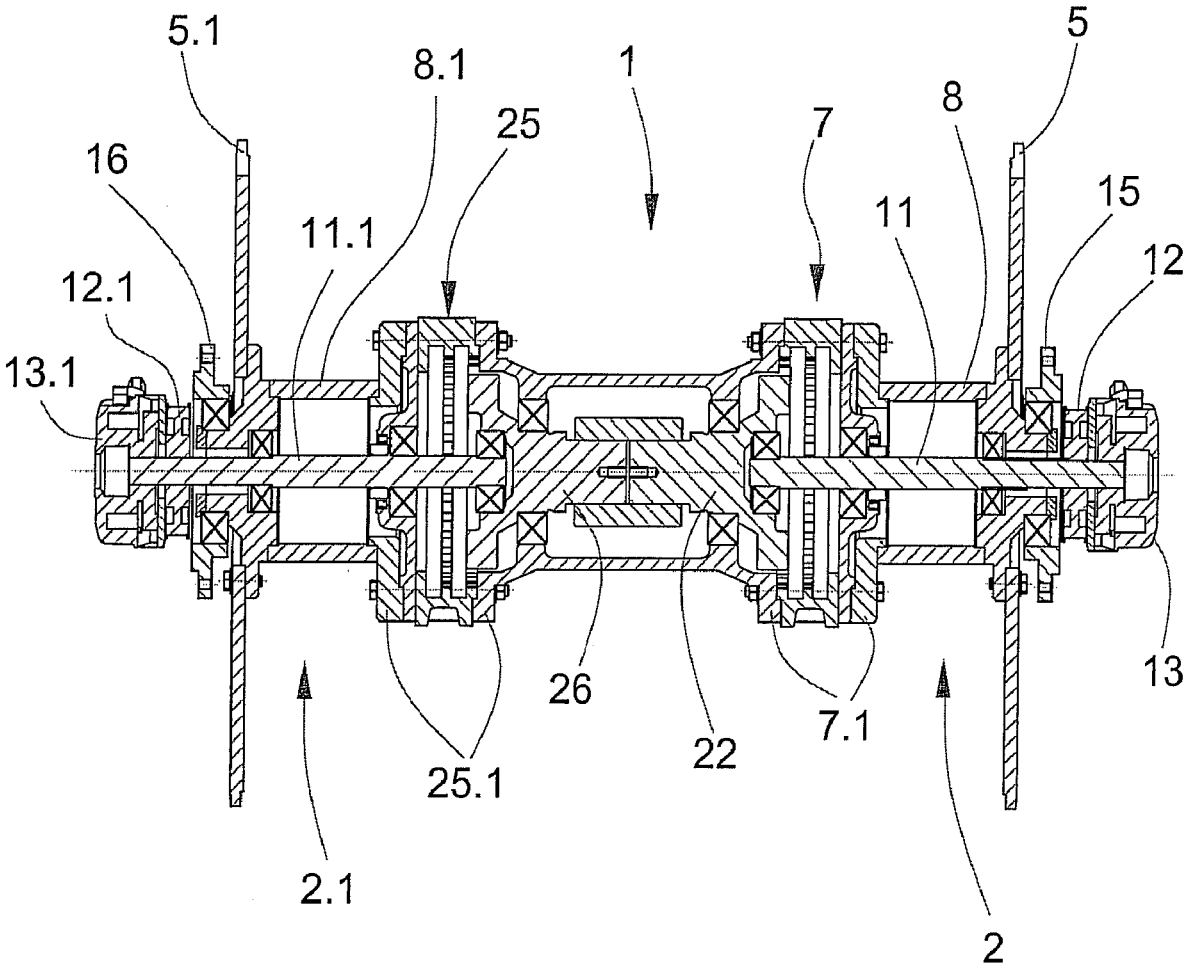
FIG. 5 is a cross-section view taken along the line B-B of FIG. 4.

FIG. 5 shows a cross section along line B-B of FIG. 4. The drive 2.1 is arranged mirror-inverted relative to drive 2. Except for the torque converter bearing for the locationally fixed gear output shafts 22, 26, the drives 2, 2.1 are comparable to the drive 2 of the single-motor variant of FIGS. 1 to 3. No torque converter bearing is required in the two-motor variant. The gear output shafts 22, 26 rest against and brace each other, whereby the rotational motion is transferred to the housing 7.1, 25.1 of the axial gears 7, 25. With the mirror-inverted arrangement, the direction of rotation of one motor and axial gear is opposite to the direction of rotation of the other motor and axial gear. Also mutually opposite are the torques on the gear output shafts 22, 26. As shown in FIG. 5, the two gear output shafts 22, 26 are mechanically coupled or connected, as a result of which no torque converter bearings are required. For the drive 2.1, the following further reference numbers are introduced: first hollow shaft 8.1, gear input shaft 11.1, housing 25.1, first pulley 9.1, second pulley 12.1, and second brake 13.1.

Figure 6:
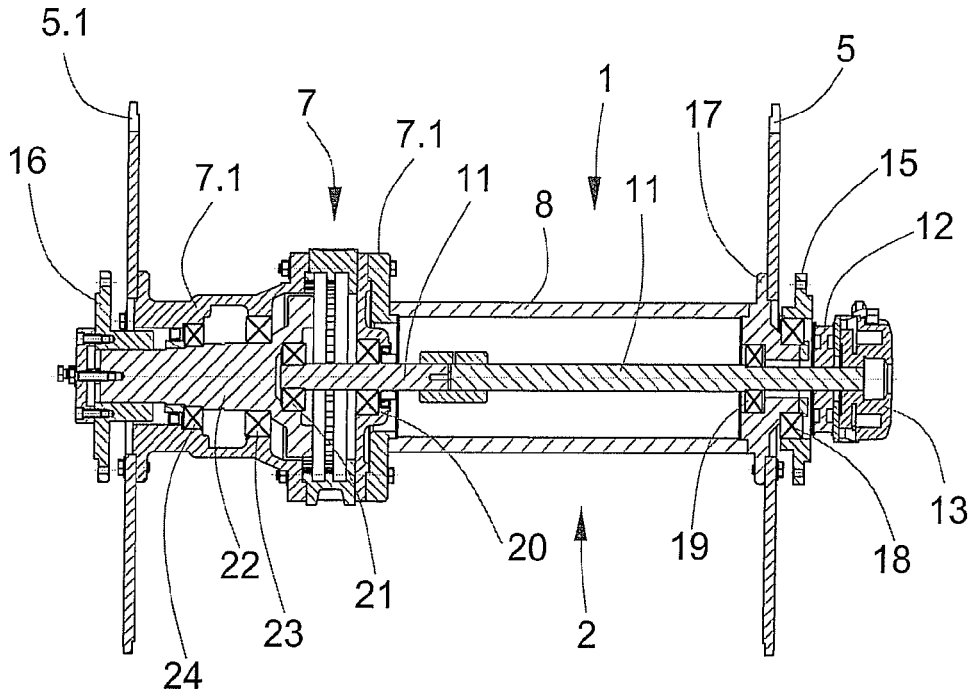
FIGS. 6, 7, and 8 present further alternative embodiments of the drive of the present invention.

FIG. 6 shows a drive 2 without second hollow shaft 14. The housing 7.1 takes on the function of the hollow shaft 14 and directly and with positive engagement adjoins the second chain wheel 5.1. An additional component can thereby be eliminated. This variant embodiment makes possible a fixing on one side and a variable embodiment or changeable length or escalator width that can be accommodated by means of the first hollow shaft 8. Furthermore, the axial gear 7 is thereby locationally determined and can transfer the rotations of the housing 7.1 to the second chain wheel 5.1 without difficulties.

Figure 7:
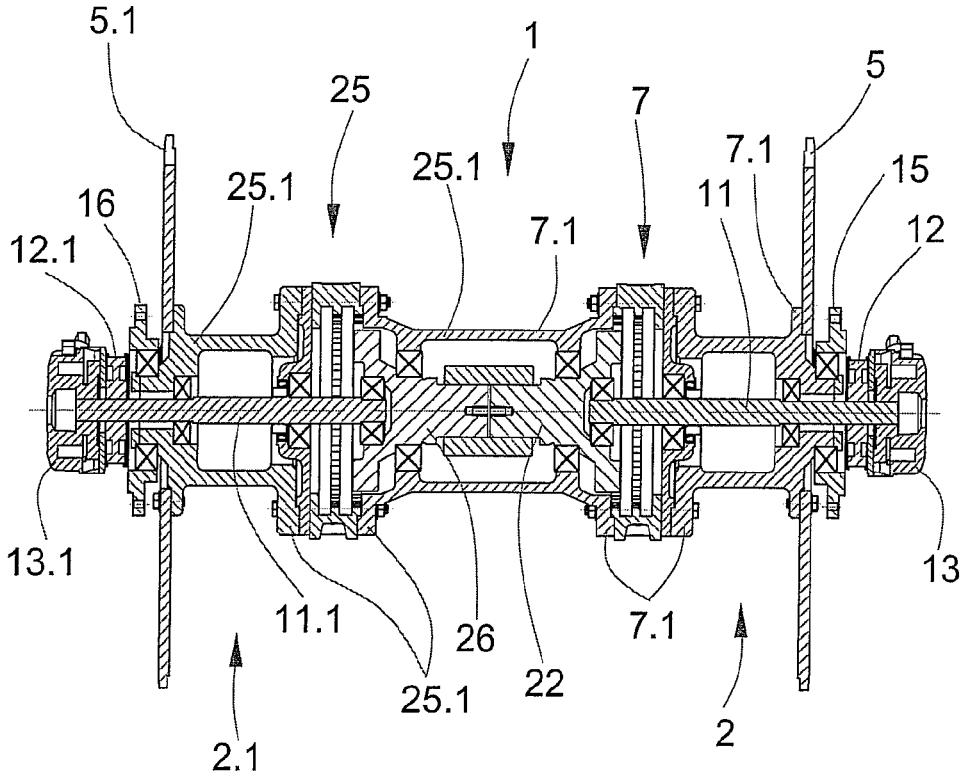

FIG. 7 shows a variant embodiment with two drives 2, 2.1 without the hollow shafts 8, 8.1. The housings 7.1 and 25.1 directly adjoin the chain wheels 5 and 5.1 and are positively engaged with the chain wheels 5 and 5.1 and transfer rotational motion. The housings 7.1, 25.1 take on the function of the hollow shafts 8, 8.1. The two axial gears 7 and 25 produce the required escalator or moving walk width and facilitate assembly through there being fewer individual parts and connecting parts. The axial gear 7 rests directly on the axial gear 25. The two housings 7.1 and 25.1 rest against each other and rotate in synchrony. The two gear output shafts 22 and 26 are still mechanically coupled. The torque converter bearing function is still defined, the two gear output shafts 22 and 26 remaining stationary.

Figure 8:
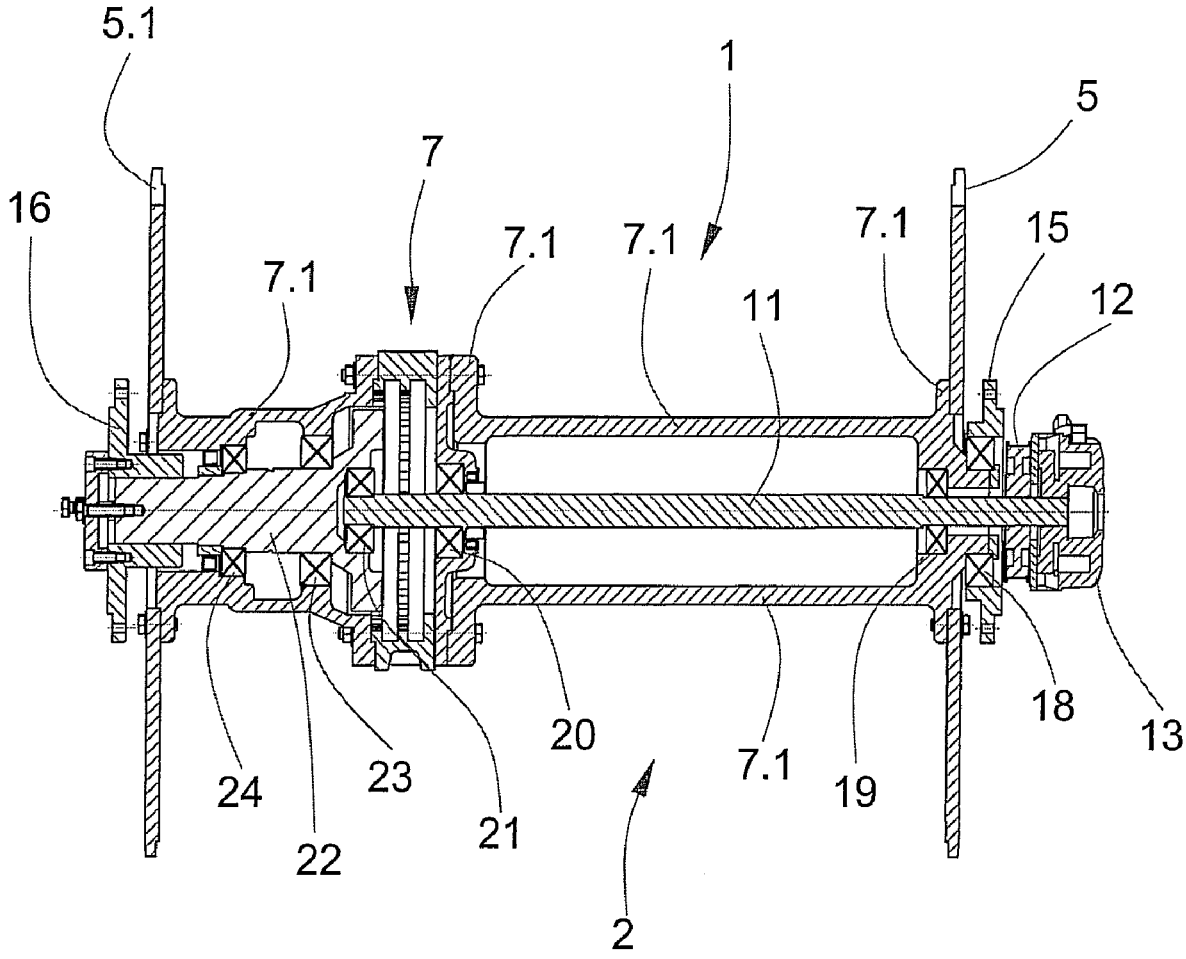

FIG. 8 shows a drive without hollow shafts 8, 14. The housing 7.1 takes on the function of the hollow shafts 8, 14 and drives both chain wheels 5 and 5.1 directly, gear 7 and housing 7.1 occupying the complete width. The hollow shaft gear that is thereby formed is compact, simple to assemble, light in weight, easy to manipulate, space saving, and inexpensive to manufacture.

We claim:

1. An escalator or moving walk with at least one drive in a reversing area between incoming and outgoing step bands or pallet bands, respectively, and driving wheels or chain wheels that are connected via shafts driven by means of the drive for driving the step band or pallet band, characterized in that at least one of the drives is arranged substantially in a space formed between side plates of the reversing area and the incoming and outgoing step bands or pallet bands, said at least one drive having an axial gear mounted on the shafts of the drive wheels or chain wheels and positioned between the drive wheels or chain wheels and having a motor that is arranged axially parallel to the shafts of the drive wheels or chain wheels, traction means coupling the motor to a fast-running gear input shaft of the axial gear, a slow-running shaft driving each drive wheel, the slow-running shaft being connected to a housing of the axial gear.

2. An escalator or moving walk according to claim 1, characterized in that the slow-running shaft is a hollow shaft.

3. An escalator or moving walk according to claim 2, characterized in that at least one further driving wheel is arranged on hollow shafts and is coupled to traction means for driving a handrail in synchrony with the driving wheels of the step band or pallet band.

4. An escalator or moving walk according to claim 1, characterized in that the slow-running shaft is configured as a part of the housing.

5. An escalator or moving walk with at least one drive in a reversing area between incoming and outgoing step bands or pallet bands, respectively, and driving wheels or chain wheels that are connected via shafts driven by means of the drive for driving the step band or pallet band, characterized in that at least one of the drives is arranged substantially in a space formed between side plates of the reversing area and the incoming and outgoing step bands or pallet bands, said drive having an axial gear mounted on shaft of the drive and a motor arranged axially parallel to the shaft, wherein traction means couples the motor to a fast-running gear input shaft of the axial gear, a slow-running shaft driving each drive wheel, the shaft being connected to the housing of the axial gear.

6. An escalator or moving walk according to claim 5, characterized in that the slow-running shaft is a hollow shaft.

7. An escalator or moving walk according to claim 6, characterized in that at least one further driving wheel is arranged on hollow shafts and is coupled to traction means for driving a handrail in synchrony with the driving wheels of the step band or pallet band.

8. An escalator or moving walk according to claim 5, characterized in that the slow-running shaft is configured as a part of the housing.

9. An escalator or moving walk according to claim 1, 5, 6, 7, or 8 wherein the axial gear has an output shaft tightly connected to one of the side plates through a torque converter bearing.

10. An escalator or moving walk according to claim 1, 5, 6, 7, or 8 wherein the drive has a second axial gear, each axial gear having an output shaft, the axial gear output shafts being connected to each other, the axial gears each having a housing, the axial gear housings being connected to each other.

* * * * *